United States Patent [19]

Kindermann et al.

[11] 4,096,841

[45] Jun. 27, 1978

[54] IGNITION SYSTEM FOR USE WITH FUEL INJECTED-SPARK IGNITED INTERNAL COMBUSTION ENGINES

[75] Inventors: Joseph C. Kindermann, Romeo; Ronald L. Colling, Millington, both of Mich.

[73] Assignee: General Motors Corporation, Detroit, Mich.

[21] Appl. No.: 694,784

[22] Filed: Jun. 10, 1976

[51] Int. Cl.[2] ..... F02B 15/00; F02B 1/02; F02M 63/06; F02M 51/06

[52] U.S. Cl. ..... 123/148 E; 123/32 SA; 123/32 AE

[58] Field of Search ..... 123/148 E, 148 DK, 148 DS, 123/148 BA, 148 A, 139 E, 32 AE, 32 SA, 32 ST, 32 SP

[56] References Cited

U.S. PATENT DOCUMENTS

| | | | |
|---|---|---|---|
| 2,018,159 | 11/1935 | Walker et al. | 123/32 AE |
| 2,718,883 | 9/1955 | Taylor | 123/32 SA |
| 2,960,973 | 11/1960 | Davis | 123/32 AE |
| 3,892,207 | 7/1975 | Weise | 123/32 SA |
| 3,913,537 | 10/1975 | Ziesche et al. | 123/139 E |

*Primary Examiner*—Verlin R. Pendegrass
*Assistant Examiner*—Thomas H. Webb
*Attorney, Agent, or Firm*—Richard G. Stahr

[57] ABSTRACT

A magnetic pickup type electrical signal generator is mounted in cooperative relationship with the movable member of each fuel injector of an associated fuel injected-spark ignited internal combustion engine. In response to the initiation of actuation of the movable member to inject fuel into the combustion chamber of the corresponding engine cylinder, the magnetic pickup signal generator produces an output signal to which an associated electronic ignition system is responsive to produce an ignition spark creating potential. Each ignition spark creating potential is directed to the spark plug of the engine cylinder into which fuel is being injected by the actuated fuel injector.

4 Claims, 3 Drawing Figures

Figure 1:
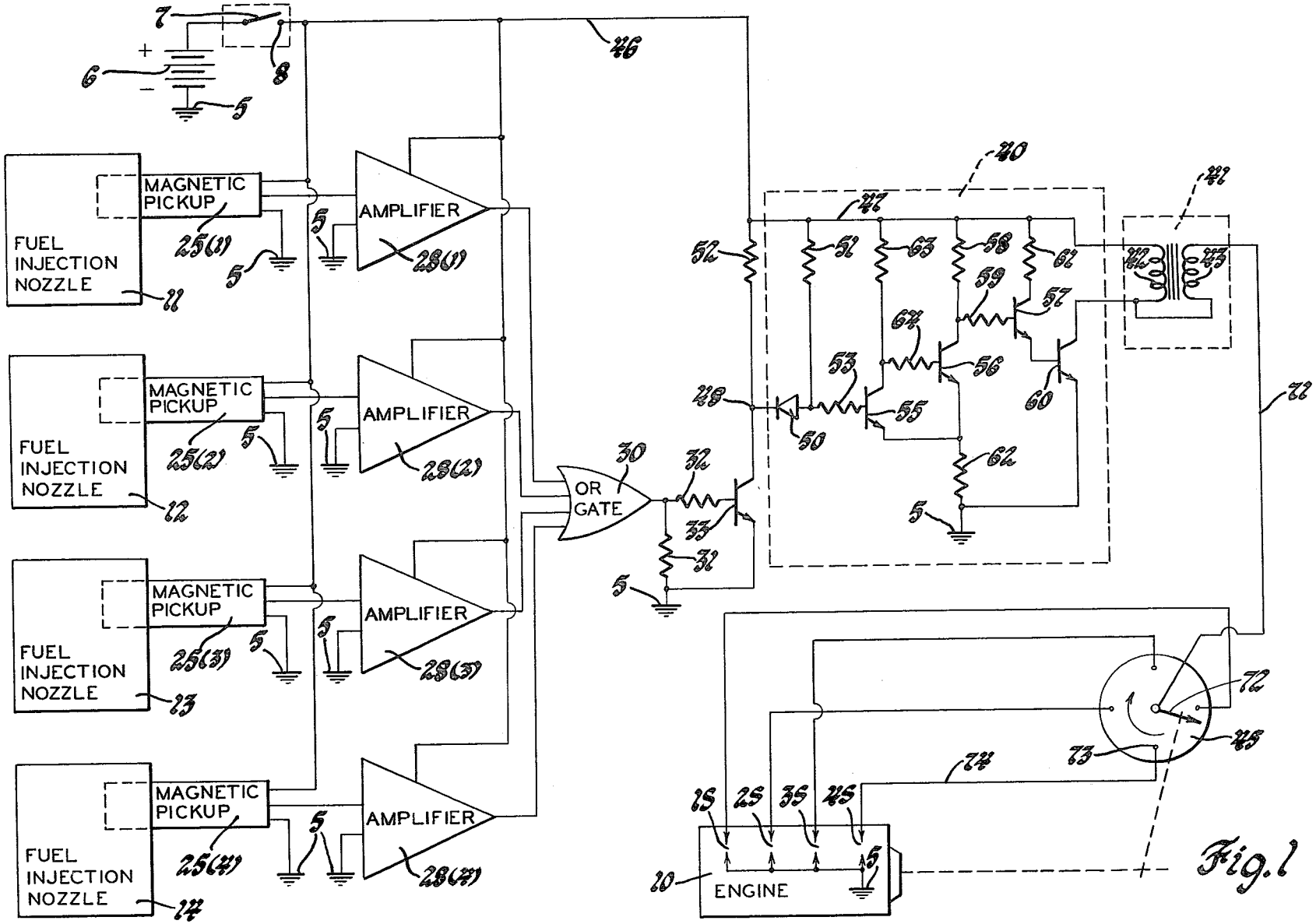

IGNITION SYSTEM FOR USE WITH FUEL INJECTED-SPARK IGNITED INTERNAL COMBUSTION ENGINES

This invention is directed to an ignition system for use with fuel injected-spark ignited internal combustion engines and, more specifically, to an ignition system for use with fuel injected-spark ignited internal combustion engines which initiates an ignition spark in response to an electrical signal produced upon the initiation of operation of each fuel injector to inject fuel.

In the prior art, internal combustion engines of the type having fuel injection and spark ignition employed separate fuel injection timing and spark ignition timing controls. Although the control system for each of these functions was referenced to engine crankshaft position, they operated independently in all other respects. Engines of the fuel injected-spark ignited type have been at best only moderately successful because of the extreme difficulty encountered in providing a satisfactory timed relationship between the fuel injection and spark ignition events.

Specifically, a significant reduction in weight and attendent cost of Diesel cycle internal combustion engines may be realized with the substitution of spark ignition for the conventional combustion ignition. A conventional Diesel cycle engine requires glow plugs for starting and is noisier than a comparable gasoline engine. This characteristic is due to the auto ignition requirements of the fuel as very high compression ratios are used to heat the fuel-air mixture to a temperature sufficient for spontaneous ignition. When spontaneous ignition occurs, a substantial portion of the fuel-air mixture may burn at once which results in the characteristic Diesel cycle engine "knock". If a spark plug is used as an ignition source, several advantages are apparent. The compression ratio would be determined only by the thermal efficiency desired instead of the cold starting requirement; the characteristic Diesel cycle engine "knock" would be eliminated as a result of the reduced ignition delay and cold starts may be accomplished without the glow plug warm-up delay. Spark ignited Diesel cycle engines have been developed, however, the problem which prevents production application of these engines is the requirement of very precise ignition spark timing. The ignition spark must occur at substantially the exact instant the first combustible fuel is injected into the vicinity of the spark plug. Therefore, an ignition system for use with direct fuel injected-spark ignited internal combustion engines which provides for the creation of an ignition spark at substantially the precise moment the injected fuel arrives at the spark plug is desirable.

It is, therefore, an object of this invention to provide an improved ignition system for use with spark ignited internal combustion engines.

It is another object of this invention to provide an improved ignition system for use with fuel injected-spark ignited internal combustion engines.

It is an additional object of this invention to provide an improved ignition system for use with fuel injected-spark ignited internal combustion engines which produces an ignition spark at substantially the precise instant the injected fuel arrives in the vicinity of the spark plugs.

In accordance with this invention, an ignition system for a fuel injected-spark ignited internal combustion engine is provided wherein an electronic type ignition system produces an ignition spark creating voltage in response to an electrical signal generated by an electrical signal generating arrangement corresponding to each fuel injector of the engine upon the initiation of actuation of the fuel injector to inject fuel into the combustion chamber of the corresponding cylinder and the ignition spark creating voltage is directed to the charge igniting device of the cylinder next to be fired.

Figure 2:
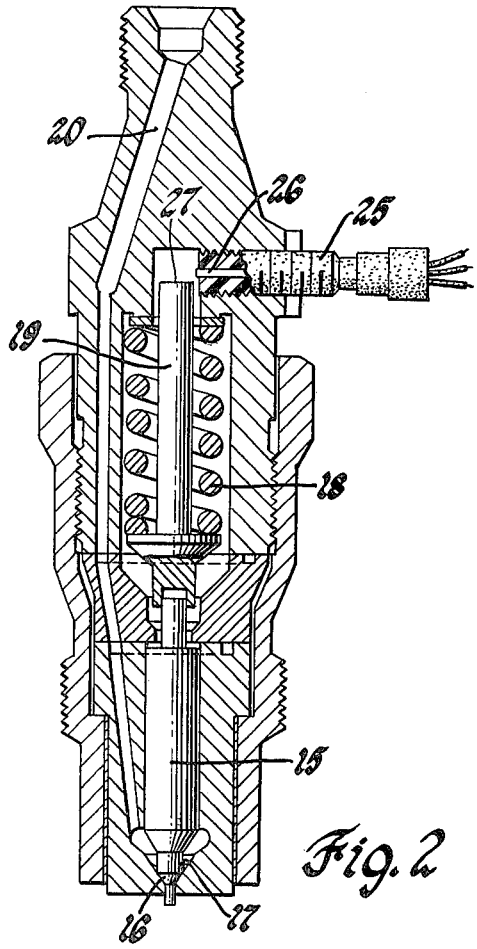
Figure 3:
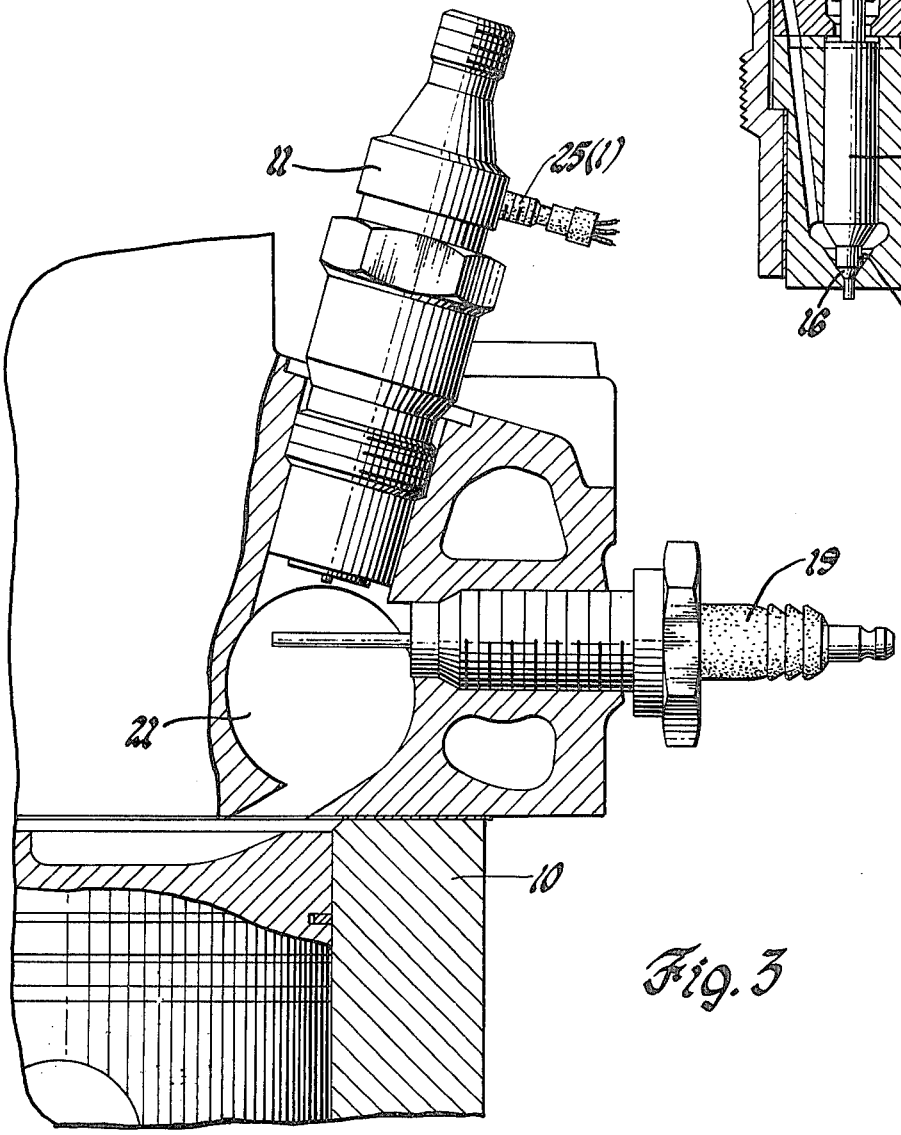

For a better understanding of the present invention, together with additional objects, advantages and features thereof, reference is made to the following description and accompanying drawing in which:

FIG. 1 sets forth the ignition system of this invention partially in schematic and partially in block form;

FIG. 2 is a section view of a fuel injector unit suitable for use with the ignition system of this invention; and FIG. 3 is a cutaway view partially in section of a typical cylinder of a fuel injected-spark ignited internal combustion engine with which the ignition system of this invention may be employed.

As point of reference or ground potential is the same point electrically throughout the system, it has been illustrated in FIG. 1 by the accepted schematic symbol and referenced by the numeral 5.

Operating potential for the ignition system of this invention may be supplied by any convenient direct current potential source, such as a conventional storage type battery 6.

Movable contact 7 and stationary contact 8 of FIG. 1 may be the normally open ignition system energizing circuit electrical contacts of a conventional automotive ignition switch of a type well-known in the art. The normally open ignition system energizing circuit electrical contacts of an automotive type ignition switch are operated to the electrical circuit closed condition while the associated internal combustion engine is in the "Crank" mode or in the "Run" mode, as is well-known in the automotive art.

The ignition system of this invention will herein be described with reference to a four cylinder fuel injected-spark ignited internal combustion engine 10 having a spark igniting device for each cylinder thereof, referenced in FIG. 1 of the drawing by the characters 1S, 2S, 3S and 4S.

Corresponding to each cylinder of the associated engine 10 is a fuel injector having a movable member for injecting fuel into the combustion chamber of the cylinder to which it corresponds upon the actuation of the movable member. In FIG. 1, the fuel injectors are illustrated in block form and are referenced by numerals 11, 12, 13, and 14 which corresponds, respectively, to engine 10 cylinders 1, 2, 3 and 4.

An elevation view in section of a typical fuel pressure actuated fuel injector suitable for use with the ignition system of this invention is set forth in FIG. 2. The movable member 15 of the fuel injector has a valve portion 16 which is normally maintained in a closed position against an accommodating valve seat 17 by the force of a helical compression spring 18 as is well-known in the fuel injector art. Although the fuel injector detailed in FIG. 2 is the fuel pressure actuated type, it is to be specifically understood that either cam or solenoid actuated fuel injector types may be employed without departing from the spirit of this invention. When fuel is to be injected, the associated injector fuel pump, not shown, delivers fuel through internal fuel passage 20 under sufficient pressure to move valve portion 16 of movable member 15 away from valve seat 17 against the force of helical compression spring 18 in a manner well-known in the fuel injector art. Upon the actuation of movable member 15 for injecting fuel into the combustion chamber 21, FIG. 3, the fuel is injected into the vicinity of the firing electrodes of spark plug 1S.

An electrical signal generating arrangement for producing an output electrical signal of a selected polarity in response to the initiation of actuation of the movable member of each fuel injector to inject fuel into the combustion chamber of the cylinder of engine 10 to which the fuel injector corresponds is provided. In the preferred embodiment, a magnetic pickup type electrical signal generator 25 is employed. In FIG. 1, the magnetic pickup type electrical signal generator for each of fuel injectors 11, 12, 13 and 14 is referenced by the reference numeral 25(1), 25(2), 25(3), and 25(4), respectively. The magnetic pickup type electrical signal generator 25 may be any suitable commercially available device. In the preferred embodiment, a model 58405 digital magnetic pickup unit commercially marketed by the Electro Corporation of Sarasota, Florida was employed. Although the particular unit employed in the preferred embodiment is of the electromagnetic type, it is to be specifically understood that magnetic pickup units of the permanent magnet type may be employed without departing from the spirit of the invention. The magnetic pickup type electrical signal generator 25 employed in the preferred embodiment is designed to mount in a ¼ inch-40 threaded hole and produces an output electrical signal pulse of a positive polarity in response to a magnetic circuit discontinuity passing the pole piece 26. The magnetic pickup type electrical signal generator 25 is mounted in the fuel injector body in such a manner that the boundary edge of terminal end 27 of member 19 is in close proximity to the lower corner, as viewing FIG. 2, of pole piece 26 while the valve portion 16 of movable member 15 is maintained in intimate contact with valve seat 17 by the force of helical compression spring 18.

In the preferred embodiment, it was found that the amplification of the electrical signal generated by each of the magnetic pickup type electrical signal generators 25(1), 25(2), 25(3) and 25(4) is desirable. Consequently, respective conventional amplifier circuits 28(1), 28(2), 28(3) and 28(4) are employed. These amplifier circuits are not absolutely necessary to the ignition system of this invention provided the electrical signal generated by the selected magnetic pickup type electrical signal generators is of a sufficient potential magnitude to activate the remainder of the circuitry. In the preferred embodiment, the type BN-9 amplifier module marketed by the Carl Cordover & Co. of Mineola, N.Y. is employed as the amplifier unit.

The output circuits of amplifier units 28(1), 28(2), 28(3), and 28(4) are applied to respective input circuit terminals of a conventional OR gate 30 of a type well-known in the art. Upon the occurrence of a positive polarity logic 1 output signal from any of the amplifier circuits, OR gate 30 produces a positive polarity logic 1 output signal which appears across resistor 31 and is applied through current limiting resistor 32 to the base electrode of an NPN transistor 33.

To produce an ignition spark creating voltage in response to each electrical signal produced by magnetic pickup type electrical signal generator units 25(1), 25(2), 25(3), and 25(4), a conventional electronic ignition system 40 and a conventional ignition coil 41 having a primary winding 42 and a secondary winding 43 may be employed. In a manner to be later explained, electronic ignition system 40 is responsive to each electrical signal produced by one of the magnetic pickup type electrical signal generators to interrupt the ignition coil 41 primary winding 42 energizing circuit. Upon the interruption of this energizing circuit, an ignition spark creating voltage is induced in secondary winding 43 and this ignition spark creating voltage is directed to the spark igniting device of the cylinder of engine 10 into which fuel is being injected by a conventional ignition distributor 45 in a manner well-known in the automotive art.

Upon the initial closure of movable contact 7 to stationary contact 8, the potential of battery 6 is applied across positive polarity potential leads 46 and 47 and point of reference or ground potential 5. At this time, the output signal of OR gate 30 is a logic 0 signal of substantially ground potential. With a substantially ground potential present upon the base electrode, NPN transistor 33 is not conductive through the collector-emitter electrodes, consequently, the potential upon junction 48 with respect to point of reference or ground potential 5 is substantially equal to the output potential of battery 6. With a positive polarity potential of a magnitude substantially equal to the operating potential of battery 6 upon junction 48, diode 50 is reverse biased as substantially the same potential is applied to the anode and the cathode electrodes thereof through respective resistors 51 and 52. With diode 50 reverse biased, base-emitter drive current is supplied to NPN transistor 55 through resistors 51 and 53. While base-emitter drive current is supplied to transistor 55, this device conducts through the collector-emitter electrodes thereof to divert base-emitter drive current from NPN transistor 56, consequently, transistor 56 is not conductive through the collector-emitter electrodes thereof. While transistor 56 is not conductive, base-emitter drive current is supplied to NPN transistor 57 through resistors 58 and 59, consequently, transistor 57 conducts through the collector-emitter electrodes thereof. While transistor 57 is conductive through the collector-emitter electrodes, base-emitter drive current is supplied to NPN switching transistor 60 through resistor 61 and the collector-emitter electrodes of conducting transistor 57. While base-emitter drive current is supplied to switching transistor 60, this device conducts through the collector-emitter electrodes to complete the ignition coil primary winding 42 energizing circuit which may be traced from the positive polarity terminal of battery 6, through movable contact 7 closed to stationary contact 8, positive polarity potential leads 46 and 47, primary winding 42, the collector-emitter electrodes of switching transistor 60 and point of reference or ground potential 5 to the negative polarity terminal of battery 6. Resistor 62 provides a reverse bias upon the emitter electrode of transistor 56 when transistor 55 is triggered conductive to provide a more sharp cutoff thereof upon the conduction of transistor 55.

Assuming for purposes of this specification that the next cylinder of engine 10 to be fired is cylinder No. 4, the movable member 15 of fuel injector 14 is actuated by the pressure of the fuel to be injected and is moved thereby in an upward direction, as viewing FIG. 2, to inject fuel into cylinder No. 4. Upon the initiation of movement of movable member 15, member 19 is also moved in an upward direction, consequently, the terminal end 27 thereof is passed rapidly by pole piece 26 of magnetic pickup type electrical signal generator 25(4). The resulting magnetic circuit discontinuity is detected by magnetic pickup type electrical signal generator 25(4) which produces a positive polarity output electrical signal. This output electrical signal is amplified by amplifier circuit 28(4) and applied to one of the input circuit terminals of OR gate 30. In response to this positive polarity logic 1 input signal, OR gate 30 produces a positive polarity logic 1 output signal which is applied through current limiting resistor 32 to the base electrode of NPN transistor 33 in the proper polarity relationship to produce base-emitter drive current through an NPN transistor. As the collector-emitter electrodes of NPN transistor 33 are connected across battery 6 through positive polarity potential lead 46 and collector resistor 52 and through point of reference or ground potential 5, respectively, in the proper polarity relationship for forward conduction through an NPN transistor, transistor 33 conducts through the collector-emitter electrodes, a condition which places junction 48 at substantially ground potential. At the moment diode 50 becomes forward biased by the substantially ground potential upon junction 48, conducting transistor 33 diverts base-emitter drive current from NPN transistor 55 to extinguish this device. With NPN transistor 55 not conducting, base-emitter drive current is supplied to NPN transistor 56 through resistors 63 and 64 in the proper polarity relationship to produce base-emitter drive current through an NPN transistor, consequently, transistor 56 conducts through the collector-emitter electrodes. Conducting transistor 56 diverts base-emitter drive current from NPN transistor 57, consequently, transistor 57 extinguishes. When transistor 57 extinguishes, base-emitter drive current is no longer supplied to NPN switching transistor 60, consequently, switching transistor 60 extinguishes to abruptly interrupt the ignition coil primary winding 42 energizing circuit previously described. Upon this abrupt interruption of the primary winding 42 energizing circuit, an ignition spark creating potential is induced in secondary winding 43 by the resulting collapsing magnetic field in a manner well-known in the automotive art. This ignition spark creating potential is directed to spark plug 4S of cylinder No. 4 of engine 10 into which fuel is being injected through lead 71, distributor rotor 72, rotated in timed relationship with engine 10 by engine 10, distributor output terminal 73 and lead 74.

The sequence of events just described is repeated sequentially for the remaining cylinders of engine 10, the complete cycle of all four cylinders of engine 10 being repeated so long as engine 10 remains in the "Run" mode.

From the foregoing description, it is apparent that the ignition system of this invention is responsive to an electrical signal produced upon the initiation of actuation of any of the fuel injectors of engine 10 to inject fuel to produce an ignition spark creating potential which strikes an ignition arc across the spark plug of the cylinder next to be fired at substantially the precise moment the injected fuel arrives in the vicinity of the spark plug.

While the ignition system of this invention has been described with reference to a four cylinder, direct fuel injected-spark ignited internal combustion engine, it is to be specifically understood that this ignition system may be also employed with other type fuel injected-spark ignited internal combustion engines without departing from the spirit of the invention.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. An ignition system for use with a fuel injected-spark ignited internal combustion engine of the type having a spark igniting device for each cylinder thereof, comprising: a fuel injector having a movable member corresponding to each cylinder of an associated internal combustion engine for injecting fuel into the combustion chamber of the said cylinder to which it corresponds upon the actuation of said movable member; means corresponding to and in cooperative relationship with the said movable member of each said fuel injector, each said means being responsive to the initiation of actuation of the corresponding said movable member to inject fuel into the combustion chamber of the said cylinder to which said fuel injector having said actuated movable member corresponds for producing an output electrical signal of a selected polarity; circuit means responsive to each said electrical signal for producing an ignition spark creating voltage; and means for directing said ignition spark creating voltage to the said spark igniting device of the said cylinder of said engine next to be fired.

2. An ignition system for use with a fuel injected-spark ignited internal combustion engine of the type having a spark igniting device for each cylinder thereof, comprising:

a fuel injector having a movable member corresponding to each cylinder of an associated internal combustion engine for injecting fuel into the combustion chamber of the said cylinder to which it corresponds upon the actuation of said movable member;

an electrical signal generating device in cooperative relationship with said movable member of each said fuel injector responsive to the initiation of actuation of said movable member to inject fuel into the combustion chamber of the said cylinder to which said fuel injector corresponds for producing an output electrical signal of a selected polarity;

circuit means responsive to each said electrical signal for producing an ignition spark creating voltage; and means for directing said ignition spark creating voltage to the said spark igniting device of the said cylinder of said engine next to be fired.

3. An ignition system for use with a fuel injected-spark ignited internal combustion engine of the type having a spark igniting device for each cylinder thereof, comprising:

a fuel injector having a movable member corresponding to each cylinder of an associated internal combustion engine for injecting fuel into the combustion chamber of the said cylinder to which it corresponds upon the actuation of said movable member;

a magnetic pickup type electrical signal generator in cooperative relationship with said movable member of each said fuel injector responsive to the initiation of actuation of said movable member to inject fuel into the combustion chamber of the said cylinder to which said fuel injector corresponds for producing an output electrical signal of a selected polarity;

circuit means responsive to each said electrical signal for producing an ignition spark creating voltage; and means for directing said ignition spark creating voltage to the said spark igniting device of the said cylinder of said engine next to be fired.

4. An ignition system for use with a fuel injected-spark ignited internal combustion engine of the type having a spark igniting device for each cylinder thereof, comprising:

a fuel injector having a movable member corresponding to each cylinder of an associated internal combustion engine for injecting fuel into the combustion chamber of the said cylinder to which it corresponds upon the actuation of said movable member;

electrical signal generating means corresponding to and operated by said movable member of each said fuel injector upon the initiation of actuation of said movable member to inject fuel into the combustion chamber of the said cylinder to which said fuel injector corresponds for producing an output electrical signal of a selected polarity;

circuit means responsive to each said electrical signal for producing an ignition spark creating voltage; and means for directing said ignition spark creating voltage to the said spark igniting device of the said cylinder of said engine next to be fired.

* * * * *